United States Patent [19]

Amour

[11] Patent Number: 4,643,208

[45] Date of Patent: Feb. 17, 1987

[54] NAIL FORM FOR USE IN APPLYING NAIL EXTENSION MATERIAL

[76] Inventor: Glenda K. Amour, 5516 Truck Village Dr., Weed, Calif. 96094

[21] Appl. No.: 670,266

[22] Filed: Nov. 13, 1984

[51] Int. Cl.[4] ..... A45D 40/30

[52] U.S. Cl. ..... 132/88.5; 132/73

[58] Field of Search ..... 132/1 R, 88.5, 88.7, 132/73, 73.5

[56] References Cited

U.S. PATENT DOCUMENTS

| | | | |
|---|---|---|---|
| 2,031,225 | 2/1936 | O'Donnell | 132/88.5 |
| 2,323,145 | 6/1943 | Mabry | 132/88.5 |
| 2,670,745 | 3/1954 | Lui | 132/88.5 |
| 2,799,282 | 7/1957 | Tinsley | 132/88.5 |
| 3,245,418 | 4/1966 | Dinerstein | 132/88.5 |
| 3,382,878 | 5/1968 | Dinerstein | 132/88.5 |
| 3,461,885 | 8/1969 | Coveney | 132/88.5 |
| 3,480,020 | 11/1969 | Yando et al. | 132/88.5 |
| 3,736,946 | 6/1973 | Yando et al. | 132/88.5 |
| 4,287,899 | 9/1981 | Robichaud | 132/73 |

*Primary Examiner*—Gene Mancene
*Assistant Examiner*—Cary E. Stone
*Attorney, Agent, or Firm*—Leonard D. Schappert

[57] ABSTRACT

A nail form for use in extending fingernails and/or toenails which limits buildup of excess nail extension material under the edge of the fingernail or toenail being worked on, thereby greatly increasing the manicurist's efficiency and reducing cleanup and risk of injury to the customer.

1 Claim, 5 Drawing Figures

NAIL FORM FOR USE IN APPLYING NAIL EXTENSION MATERIAL

BACKGROUND OF THE INVENTION

1. Field of the Invention.

The present invention relates generally to the field of manicuring, and more specifically to devices utilized by manicurists to assist in the construction of extended fingernails and/or toenails.

2. Description of the Prior Art.

In the past inventors have directed their efforts toward developing shields which assist in the construction of extensions of nails and which utilize foil to shield most skin surfaces around the fingernail or toenail from contact with the nail extension material during the fingernail or toenail extension process. Such shields have considerably expanded the ability of manicurists and pedicurists to extend nails artifically, but problems relating to efficiency and injury have continued. One such problem is caused by a buildup of excess extension material on the bottom surface of the end of the fingernail or toenail. Such excess material must be removed, and this operation decreases the efficiency of manicurists and pedicurists. The removal of excess material is accomplished with sharp implements which greatly increase the likelihood of injury to an individual's finger or toe. The present invention virtually eliminates this operation, greatly increasing efficiency and decreasing the likelihood of injury in the process.

None of the prior art of which applicant is aware discloses or teaches a nail form for use in the application of nail extension material which has the unique characteristics of the present invention.

SUMMARY OF THE INVENTION

The present invention consists of a nail form for use in the application of acrylic or other nail material to fingernails and/or toenails having a cutout area such that the nail form fits under the end of the nail and around the nail, covering the skin areas adjacent to the nail so that they are protected from contact with the nail extension material being utilized to extend the nail.

The nail form is constructed of nonporous material such as foil, with adhesive substantially covering the bottom surface, which contacts the skin of the finger, and with a small amount of adhesive positioned on the top surface in the area which normally fits underneath the end of the nail. The adhesive enables a manicurist to secure the nail form to the skin of the finger or toe around the nail, and also to the bottom surface of the end of the nail, thereby limiting buildup of nail extension material underneath the edge of the nail.

One of the objects of the present invention is to provide a nail form to enable manicurists and pedicurists to apply nail extension material efficiciently to develop a longer fingernail or toenail.

Another object of the present invention is to provide a nail form which is securely attachable to the skin of the finger or toe and to the bottom surface of the end of the nail which is being worked on.

A further object of the present invention is to provide a nail form which, because of the unique placement of adhesive thereon, is attachable to the bottom surface of the end of the nail which is being extended so that buildup of nail extension material underneath the end of the nail is substantially eliminated. This feature considerably reduces the cleanup which a manicurist or pedicurist is required to complete, further increasing the efficiency with which a manicurist or pedicurist can apply nail extensions and greatly reducing the risk of injury to an individual's finger or toe during cleanup.

The foregoing objects, as well as other objects and benefits of the present invention, are made more apparent by the descriptions and claims which follow.

DESCRIPTION OF THE PREFERRED EMBODIMENT

Figure 1:
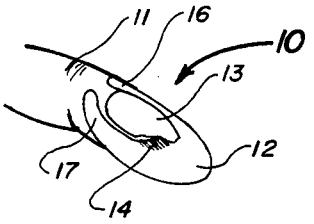
FIG. 1 is a perspective view of a finger and fingernail showing the nail form in position prior to the application of nail extension material.

The present invention consists of nail form 10 having a substantially oval shape, more specifically including a platform 12 which extends outward from the end of the nail when in use, and side extensions 16 and 17 which extend around the sides of the nail during use. FIG. 1 shows nail form 10 in position around fingernail 13 of finger 11. Fingernail 13 is partially cut away to expose adhesive 14, which is placed on the top surface of platform 12 to adhere nail form 10 to the bottom surface of the end of fingernail 13.

Figure 2:
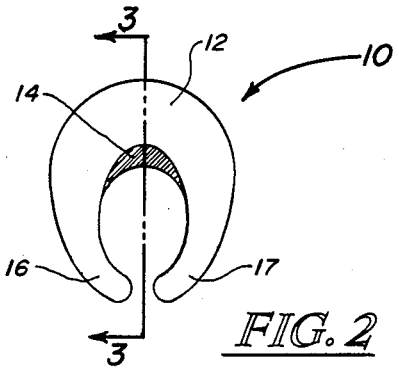
FIG. 2 is a top view showing the shape and various features of the nail form.
Figure 3:
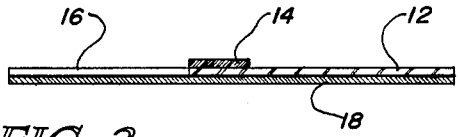
FIG. 3 is a cross-sectional view taken along lines 3—3 of FIG. 2 showing the construction of the nail form.

FIGS. 2 and 3 of the drawings show the shape and construction of nail form 10 in greater detail, FIG. 3 being a cross-sectional view taken along lines 3—3 of FIG. 2. Nail form 10 consists of a continuous sheet of nonporous material, such as metallic foil, and is cut in the shape shown in FIG. 2 to form a platform 12 and side extensions 16 and 17. As shown in FIG. 3, adhesive 14 is placed in a small area on the top surface of platform 12 of nail form 10, while the bottom surface of nail form 10 is substantially completely coated with adhesive 18.

Figure 4:
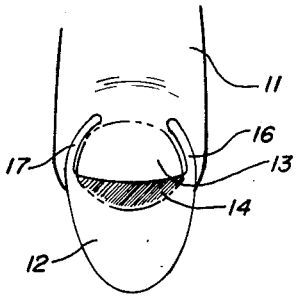
FIG. 4 is an end perspective view of the nail form in position on a finger more clearly showing its position during use.

FIG. 4 is an end perspective view of finger 11 with nail form 10 attached. In this view the relationship between platform 12, adhesive 14 and fingernail 13 is more clearly shown, as is the positioning of side extensions 16 and 17 with respect to fingernail 13. Fingernail 13 is shown by dashed lines in order to illustrate more clearly the placement of nail form 10 and adhesive 14 with respect to fingernail 13.

Figure 5:
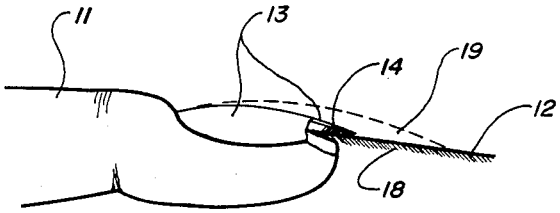
FIG. 5 is a side view of a finger with appropriate cutaways showing construction of the nail extension and the use of the nail form in constructing the nail extension.

FIG. 5 is a side view of finger 11 with nail form 10 attached showing how the use of nail form 10 relates to the final development of nail extension 19. Fingernail 13 and finger 11 are partially cut away to expose the area of contact between platform 12 and the bottom surface of the end of fingernail 13, showing more clearly the effectiveness of adhesive 14 in eliminating buildup of nail extension material under the end of fingernail 13. The anticipated nail extension 19 is shown by dashed lines extending from fingernail 13 to the top surface of platform 12.

As is shown by FIGS. 4 and 5, adhesive 14 holds the top surface of platform 12 of nail form 10 securely against the bottom surface of the end of fingernail 13. Such adhesion causes the underside of the tip of fingernail 13 to remain substantially free of nail extension material, thereby limiting the cleanup normally required of the manicurist or pedicurist.

While the foregoing description of the invention has shown a preferred embodiment using specific terms, such description is for illustrative purposes only. It It is applicant's intention that changes and variations may be made without departure from the spirit or scope of the following claims, and this disclosure is not intended to limit applicant's protection in any way.

I claim:

1. A nail form for use in extending a nail by applying nail extension material to said nail form and said nail, comprising:

a sheet of nonporous material having a top surface and a bottom surface and consisting of a platform and two side extensions, both extending outward from said platform in the same general direction, with an open area between said side extensions, said open area being bordered on two sides by said side extensions and on one end by said platform and having a substantially oval shape so that, when said platform is positioned under the edge of a nail with said top surface facing said nail, said side extensions extend around said nail, leaving said nail exposed while covering skin adjacent to said nail;

first adhesive material covering said bottom surface of said sheet of nonporous material and positioned so that said bottom surface of said sheet securely attaches to said skin when said platform is positioned under said edge of said nail and said extensions extend around said nail, contacting said skin adjacent to said nail, and second adhesive material covering a small area of said top surface of said platform, said small area covered by said second adhesive material being positioned along the edge of said platform adjacent to said open area, whereby said top surface of said platform securely attaches to the bottom surface of said nail when said platform is positioned under said edge of said nail, thereby limiting buildup of said nail extension material under said edge of said nail, increasing a manicurist's efficiency, reducing cleanup required and reducing likelihood of injury to a customer during cleanup.

* * * * *